United States Patent [19]

Adamson

[11] 4,305,338

[45] Dec. 15, 1981

[54] PROCESS AND APPARATUS FOR AFFIXING LABELS TO GARMENTS AND THE LIKE

[75] Inventor: Fletcher D. Adamson, Alexander City, Ala.

[73] Assignee: Russell Corporation, Alexander City, Ala.

[21] Appl. No.: 111,725

[22] Filed: Jan. 14, 1980

[51] Int. Cl.[3] ..... D05B 3/22

[52] U.S. Cl. ..... 112/113; 112/121.12

[58] Field of Search ..... 112/121.12, 121.11, 112/121.15, 121.29, 113, 104, 102

[56] References Cited

U.S. PATENT DOCUMENTS

| | | | |
|---|---|---|---|
| 2,982,238 | 5/1961 | Fromm | 112/121.11 |
| 3,170,423 | 2/1965 | Henebry | 112/102 X |
| 3,386,396 | 6/1968 | Jacobs et al. | 112/121.12 |
| 3,474,747 | 10/1969 | Noiles | 112/121.12 |
| 3,543,737 | 12/1970 | Maschmann | 112/121.12 |

*Primary Examiner*—H. Hampton Hunter

*Attorney, Agent, or Firm*—Woodford R. Thompson, Jr.

[57] ABSTRACT

Disclosed is a process and apparatus for affixing, specifically, sewing, labels to garments and the like. The process comprises the removal of labels one by one from a vertically disposed stack of the same located adjacent the sewing station. These labels are lifted vertically from the stack, transferred to the sewing station by swinging the label transversely from over the stack to a position over the sewing station. Upon arrival thereat the label is lowered vertically onto the workpiece such as a garment at said sewing station. The label is then held in contact with the workpiece by pressing downwardly about at least a portion of its periphery and while so held is sewed to the workpiece. The apparatus comprises a magazine for a vertically arranged stack of labels, together with a pneumatic pick-up device which is operable to remove the labels one by one from the top of the stack and transfer them to the sewing station. The sewing station may be a commercial sewing machine equipped with a hold-down member for the label, which hold-down member generally is in the form of a centrally open frame-like member. The label is delivered through the top of a hold-down member, namely, through the opening thereof, and snaps under the periphery of the hold-down member, which lowers, holding the label at least about a portion of its periphery. The label is then sewn with a continuous stitch, just inside the periphery of the label thus securing it to the garment.

3 Claims, 9 Drawing Figures

FIG. 7
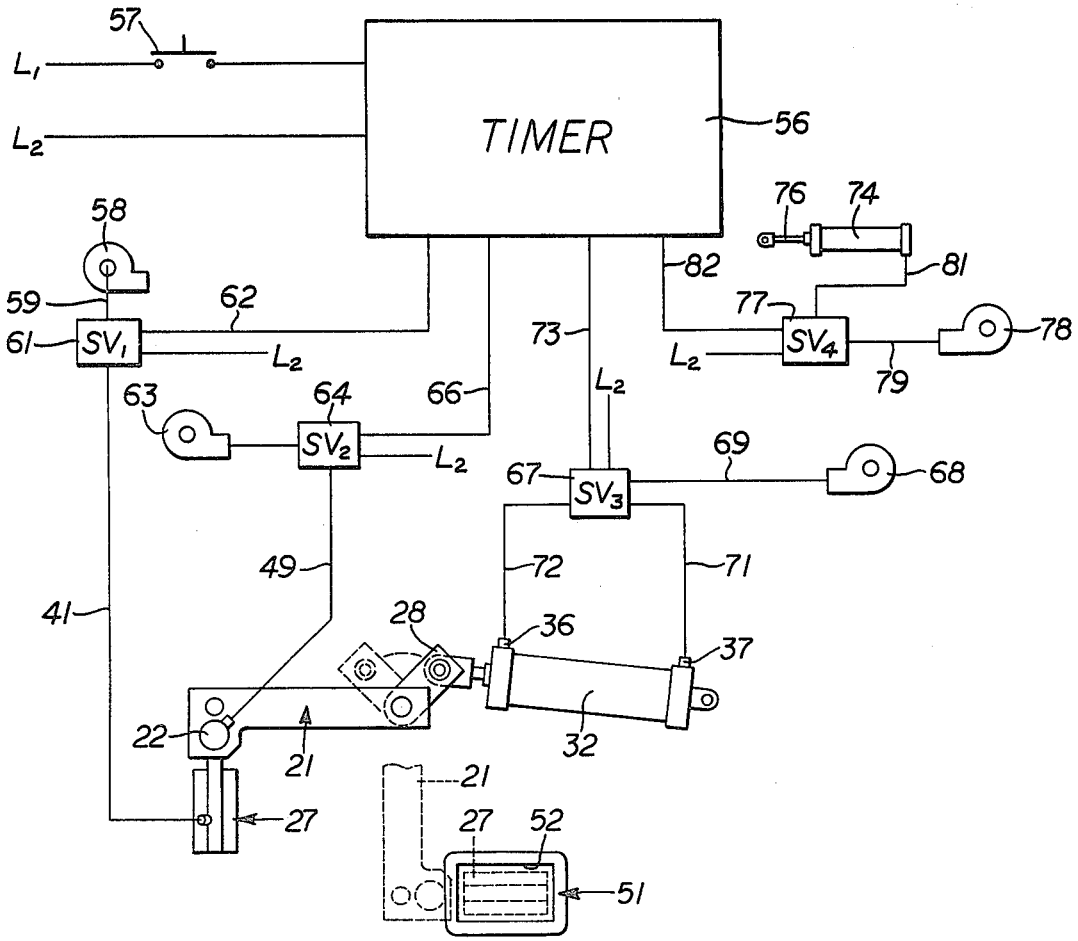
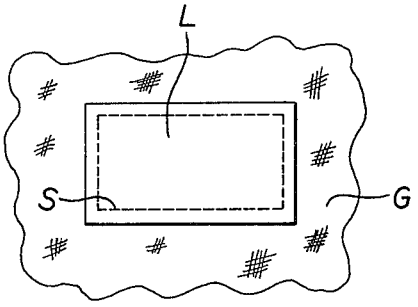
FIG. 8

PROCESS AND APPARATUS FOR AFFIXING LABELS TO GARMENTS AND THE LIKE

This invention relates to a process and apparatus for securing labels, such as cloth labels, to workpieces, such as garments.

In this art it heretofore has been customary for the operator of the sewing machine first manually to place the workpiece in position beneath the presser foot of the machine. The operator next selects a label by hand and positions it, by eye, in position beneath a hold-down member of the sewing machine. The machine hold-down member or presser foot is then lowered, the operator presses a start level, and the machine automatically sews a complete stitch around the label, affixing it to the garment or other workpiece.

Several difficulties are present in the aforesaid manual type of positioning these labels for sewing. First, such operation is an extremely slow one, the usual, skilled operator, only being able to affix about 91 labels per hour. Second, the handling of the labels, which generally are small pieces of fabric with information carried thereon, is a tedious and somewhat delicate operation, particularly in a repetitious, mass production operation. The operators do their best to maintain a high rate of production and inevitably, many times during a work-day, will either drop the label on the floor, thus further slowing the work, or, many times, misposition it under the machine parts so that either the label is sewn on incorrectly or in an incorrect fashion. In such cases the label has to be removed and a new start made. Third, the process of picking up the labels one by one from a stack or a pile and separating them with the fingers and then placing them under the machine parts for sewing is a tiring, inefficient, and monotonous task.

With the foregoing in mind, an object of my invention is to provide a process of the character designated in which there is provided, near the sewing station, a vertically arranged stack of labels, preferably a stack which is held in vertical position in a sort of hopper. This stack of labels is located conveniently to the sewing station of the sewing machine. The next step in my improved process is to lift the labels, one by one, from the top of the stack, moving them vertically and then transversely of the stack to a position over the sewing station. The labels are then lowered vertically onto the workpiece and when in place are held against the workpiece by pressing downwardly about at least a portion of the periphery of the label. The thus delivered, precisely positioned and held label is then sewn to the workpiece by the sewing machine.

My improved apparatus comprises, in general, means to maintain a vertical stack of the labels, for instance by means of a hopper located closely adjacent the work station. Mounted so as to come in contact with the uppermost label of the stack is a vertically movable arm. The arm carries a suction head which, when pressed against the top of the stack, will pick up the topmost label. The arm carrying one label is then moved vertically and then is rotated so that the head moves transversely of the stack, over the hold-down means of the sewing machine. Upon reaching this latter position the arm again moves downwardly, whereby the label is passed vertically downwardly through the open framework of the sewing machine hold-down means and its edges thereby snap under the edges of the open hold-down member. The vacuum is now released and the arm again moves upwardly, and thence back to its position over the stack. The hold-down member for the sewing machine then moves downwardly, pressing the label against the workpiece by engaging the label substantially around its periphery. The thus positioned label is then sewn in the ordinary fashion by the sewing machine.

From the foregoing it will be seen that the principal object of my invention is to provide a process and apparatus of the character designated which shall eliminate the difficulties of the hand placing of labels as heretofore practiced.

Specifically, an object of my invention is to provide a process of the character designated in which, instead of the labels being randomly moved from a pile or stack thereof to a position for sewing, are moved through a definite path of travel, namely, vertically off the stack, over the sewing station, downwardly onto the workpiece precisely positioned at the sewing station, clamped about the periphery, and then sewn.

Another object is to provide apparatus of the character designated which is fully capable of carrying out my improved process and which also shall be reliable in operation and simple in construction and maintenance.

Apparatus illustrating the constructional features of my invention and which may also be used to carry out my improved process is shown in the accompanying drawings, forming a part of this application, in which:

FIG. 7 is a wholly diagrammatic wiring and pneumatic diagram;

FIG. 8 is a fragmental plan view of a portion of a workpiece with a label sewn thereto; and, FIG. 9 is a diagrammatic side elevational view of a sewing machine which may be used with my invention.

Figure 1:
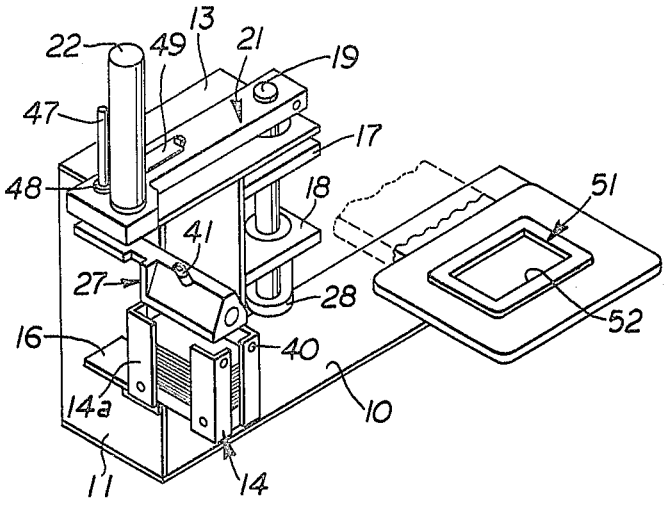
FIG. 1 is a fragmental, somewhat diagrammatic view of my improved apparatus with the parts in position for the vacuum pick-up head to be lowered onto the uppermost one of a stack of labels, the hold-down means of the sewing machine being illustrated diagrammatically and removed from the remaining portions of the sewing machine.
Figure 2:
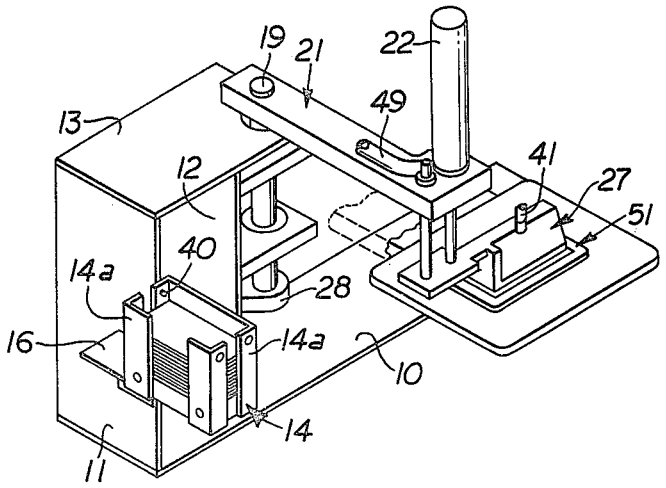
FIG. 2 is a view with the parts in position to deliver a label to the hold-down means of a sewing machine.

Referring now to the drawings for a better understanding of my invention, I show in FIGS. 1 and 2 a base or support member 10 which may be affixed to the sewing deck of the sewing machine. Upstanding from the base 10 are vertical frame members 11 and 12 in the form of plates. A horizontal top plate 13 is secured to the upper ends of the members 11 and 12. Mounted on the outer side of the plate 11 is a hopper 14 for receiving a vertical stack of labels L. As shown, this hopper may comprise a plurality of angles 14[a] secured to an L-shaped bracket 16 carried by the member 11. The hopper is open at its top so as to make accessible the uppermost label therein.

Figure 6:
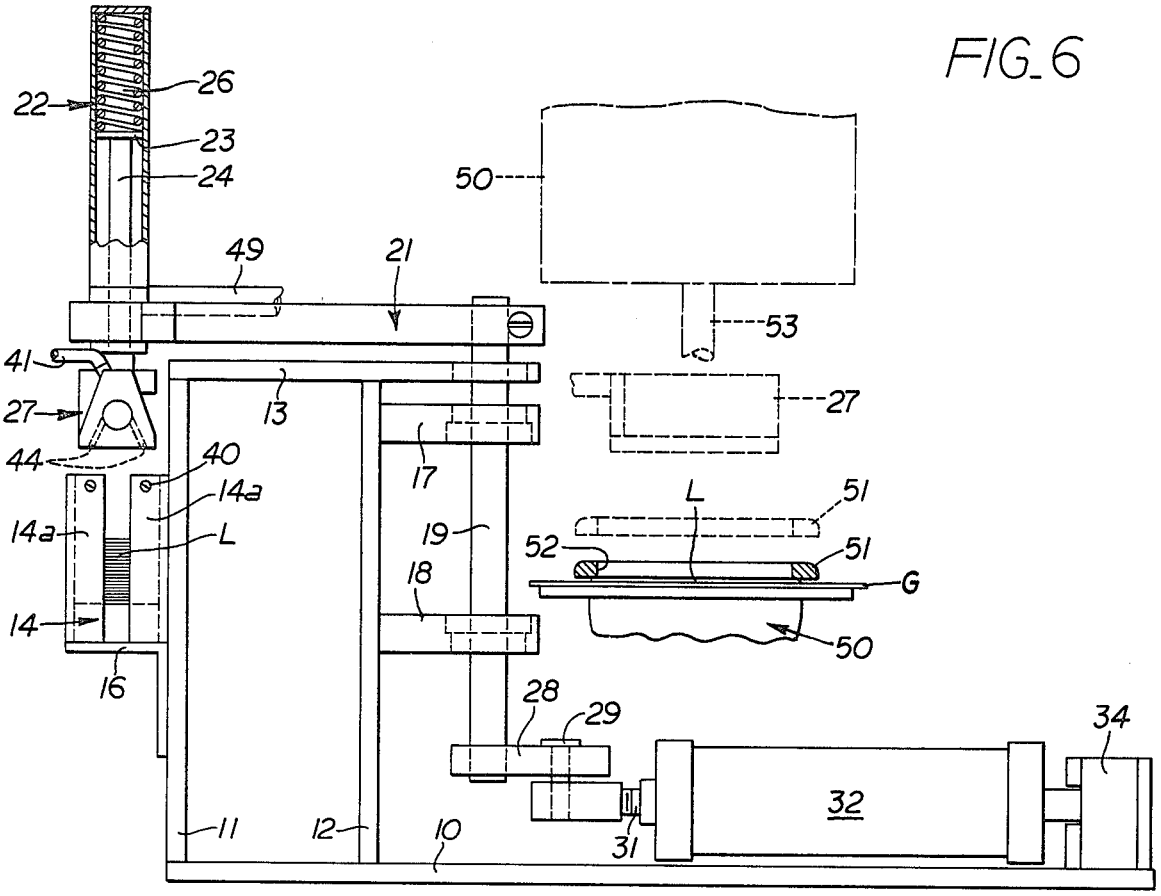
FIG. 6 is a diagrammatic view, partly in section, showing a label being held in sewing position by the vertically movable hold-down member of the sewing machine with the label transfer mechanism over the hopper, ready to be lowered to pick up another label, the dotted lines illustrating the position of some of the parts during the process of delivering the label and holding it.
Figure 5:
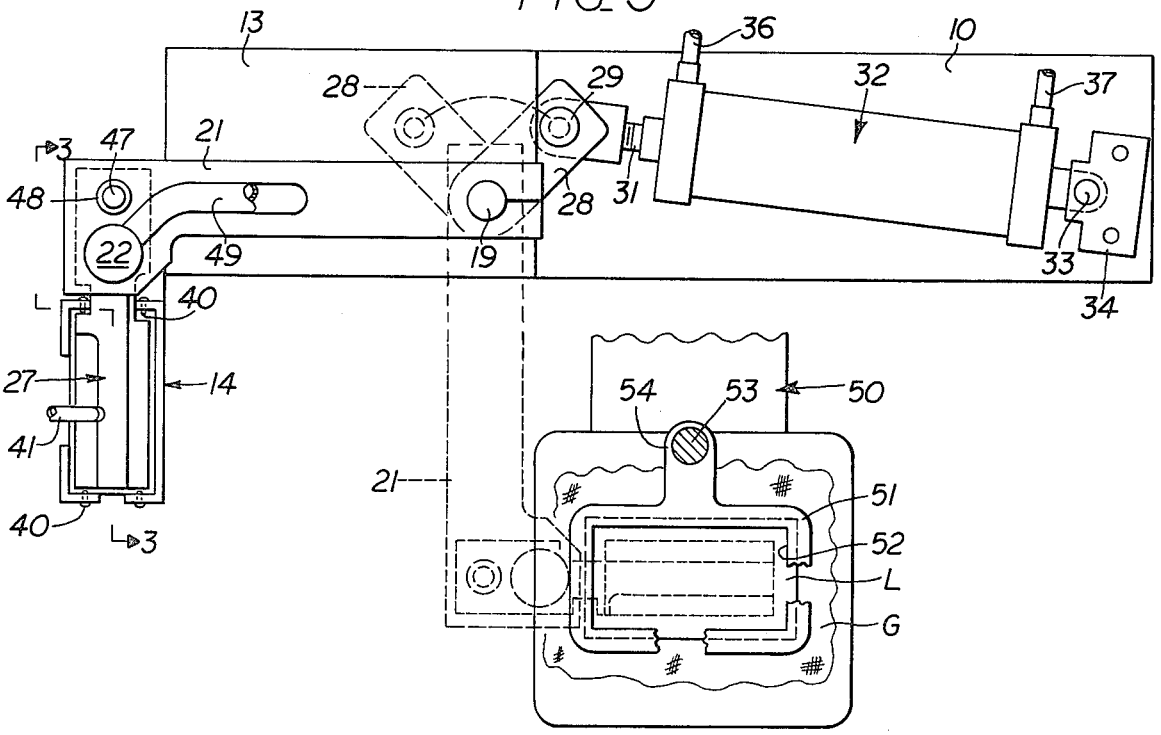
FIG. 5 is a detail plan view with certain parts in section and illustrating the position of the label pick-up mechanism in full lines in label pick-up position and in dotted lines in position over the sewing machine hold-down member.
Figure 9:
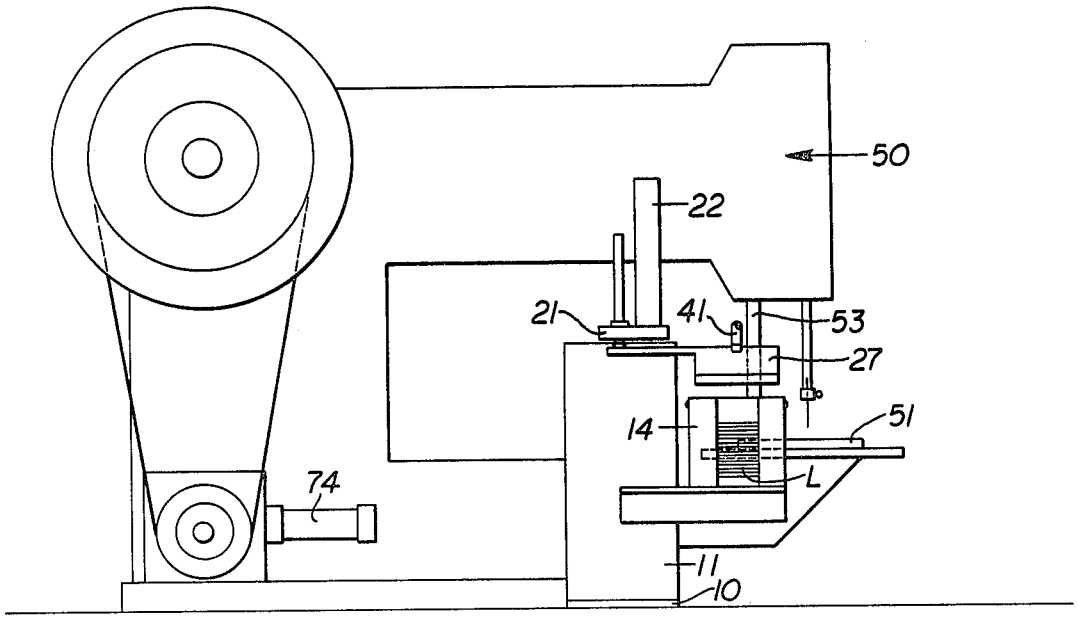

Mounted in bearing plates 17 and 18 carried by the plate 12 is a shaft 19. Secured non-rotatably to the upper end of the shaft 19 is a horizontally disposed arm 21. Adjacent its free end arm 21 carries an air cylinder 22, vertically arranged, such cylinder being equipped with the usual piston 23 and piston rod 24. A spring 26 biases the piston and hence the arm downwardly as shown in FIG. 6.

The piston rod 24 passes slidably through the arm 21 and at its lower end carries a vacuum pick-up head indicated generally by the numeral 27.

At its lower end the shaft 19 has affixed thereto an arm 28. Pivotally connected to the free end of arm 28 as at 29 is the outer end of a piston rod 31 carried by a double acting air cylinder 32. The cylinder itself is pivoted at 33 to a bracket 34 upstanding from plate 10. Air under pressure may be admitted selectively to the ends of cylinder 32 through connections 36 and 37, as will later be explained.

Figure 3:
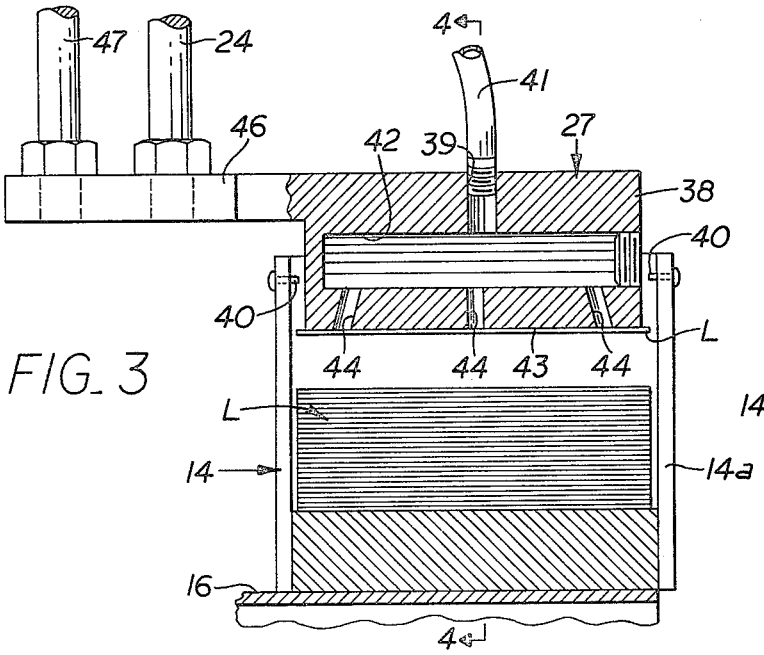
FIG. 3 is an enlarged detail sectional view taken generally along line 3—3 of FIG. 5.
Figure 4:
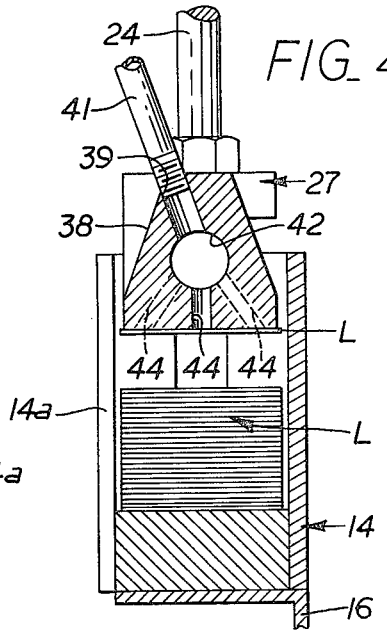
FIG. 4 is an enlarged detail view taken generally along line 4—4 of FIG. 3.

Referring particularly to FIGS. 3 and 4, it will be seen that the head 27 comprises a body portion proper indicated at 38. The body is provided with a threaded opening 39 to which may be connected a flexible hose 41. The opening 39 leads to a cross opening 42. The bottom portion or face 43 of the head 27 has therein a plurality of openings 44 in communication with the opening 42. As will later appear, when vacuum is applied through the line 41 to the head and the head is placed against the upper surface of one of the labels L in the hopper. To aid in separating the label being removed from the next subjacent one, I may provide a plurality of projections 40 against which the ends of the labels brush as they are being lifted thus to strip from the head all labels except the one being removed.

The upper portion of the head 27 is provided with an extension 46. The lower end of the piston rod 24 is secured to the extension 46 as shown in FIG. 3. A guide rod 47 is also secured to the extension 46 and projects upwardly slidably to pass through a bushing or bearing 48 carried by the free end of the arm 21.

Reverting again to cylinder 22, it will be seen that air under pressure may be supplied to the lower end of that cylinder through a conduit 49.

As shown in the several views of the drawings, the sewing machine 50 is equipped with a label hold-down member 51. As is understood in the art, the hold-down member 51 is provided at its center with an opening 52. Furthermore, the member 51 is carried by the sewing machine proper and is vertically movable approximately from the full line position of FIG. 6 to the dotted line position shown in that view. In FIG. 6 I have indicated diagrammatically at 50 the sewing machine which carries a vertically reciprocable portion 53 which is secured to an extension 54 carried by the hold-down member 51.

While there may be various types of commercial sewing machines available on the market which will be useful in my invention, a particular one can be purchased from PFAFF Machine Co. of West Germany, and is known as their model 3335 H.J. Suffice it here to say that when the sewing machine 50 is ready to receive a label from my improved apparatus, the hold-down member 51 is in the raised, dotted position of FIG. 6.

From what has been so far described, it will be seen that starting with the parts in the position of FIG. 1, namely, with the head 27 vertically aligned over the stack of labels in the hopper 14 and with the member 51 raised to the dotted line position of FIG. 1, the head may be lowered downwardly onto the uppermost label L in the hopper. Vacuum is now applied to the head 27 through the line 41 whereupon the uppermost label of the stack is held by vacuum to the under surface of the head. The head carrying such label is then raised to the position out of the magazine by pressurizing cylinder 22 through line 49. Cylinder 32 is now pressurized through its air connection 37, extending the piston rod 31 and rotating the shaft 19 and hence the head carrying the label to a position directly over the opening 52 in the hold-down member 51, which at this time is raised. Depressurization of cylinder 22 permits the spring 26 thereof to move the head downwardly, through the opening 52, the head 27 being so sized as to pass through the opening 52. Also, the pick-up surface of the head 27 is slightly smaller in overall dimensions than the label so that the label projects slightly from the sides and ends thereof as clearly shown in FIGS. 3 and 4. Thus, with the hold-down member 51 raised the head passes far enough thereinto to permit the label to snap or uncurl beneath the member 51 to the position thereof as shown in FIG. 6. The vacuum on head 27 is removed and the head is raised and starts the return toward the hopper 14. When this is accomplished the member 51 is lowered in the customary manner of sewing machines of the above type, holding the label firmly against the garment of workpiece G shown in FIG. 6. The sewing is then accomplished by the sewing machine in the usual fashion. That is to say, as shown in FIG. 8, a line of stitching S is shown around the label, just inside of the opening 52 of the hold-down member 51.

Referring particularly to FIG. 7 of the drawings, I will now explain a system for automating the entire operation, including the energization of the sewing machine to provide a process and apparatus in which the only thing the operator does is to slip the garment G under the hold-down member, in position for the sewing to take place, and press a start button. At 56 I show a timer, indicated diagrammatically, under control of a momentarily closable, manual push button switch 57. Upon closing the switch 57, momentarily, the timer times in and the entire sequence hereafter to be described takes place, whereupon the timer times out and the parts are ready for another cycle.

At 58 I show a vacuum pump which is connected by a line 59 to a solenoid valve 61. The solenoid valve 61 is connected to the head 27 through line 41. Electrical circuits 62 connect solenoid valve 61 to the timer 56.

At 63 I show a pump which, through another solenoid valve 64, is connected to the line 49 leading to the bottom of the cylinder 22. A circuit 66 connects solenoid valve 64 to the timer 56.

A third solenoid valve 67 receives pressure from a pump 68 through a line 69. The valve 67 is connected by a line 71 to the opening 37 in one end of the cylinder 32 and by a line 72 to the other end of the cylinder 32 through the connection 36. A circuit 73 connects the solenoid valve 69 to the timer.

At 74 I show a hydraulic cylinder having a piston rod 76 which is connected to the sewing machine in the fashion fully understood in the art. A solenoid valve 77 receives pressure from a pump 78 through a line 79. This pressure is transmitted to cylinder 74 through a line 81. The valve 77 is in circuit with the timer through a circuit 82.

With the foregoing in mind the complete cycle of operation of my improved apparatus may now be described. Starting with the parts in the position of FIG. 1 of the drawings, namely, with the switch 57 having been momentarily closed and the timer timed in, pressure is then being supplied to the lower end of cylinder 22 through the line of pneumatic connection 41. As the timer progresses this pressure is released, due to actuation of the valve 64, whereupon the spring 26 forces the head 27 downwardly, to rest on top of the uppermost label L in the hopper 14. The timer then actuates solenoid valve 61, placing vacuum on the pick-up head 27. This causes the uppermost label L to adhere to the lower surface 43 of the head 27 whereupon the label adheres or is "struck" to such surface. The timer 56 again actuates solenoid valve 64, placing pressure under the bottom of piston 23 of cylinder 22, raising the head and the label carried thereby out of the hopper 14.

The next operation is for the timer to actuate valve 67 to energize the port 37 of cylinder 32, swinging arm 28 and hence arm 21 from a position directly over the hopper to a position directly over the hold-down member 51. At this time the timer 56 again actuates solenoid valve 64, relieving the pressure in line 49 and permitting spring 26 to force the head carrying the label downwardly through the opening 52 in the hold-down member 51, thus causing the label L to pass completely through the member 51, permitting its edges to snap into the position shown in FIG. 6. That is to say, due to the configuration of the parts and the relative sizes thereof, with the member 51 raised to the dotted line position of FIG. 6, the label and a portion of the head 27 pass completely through said member 51. The label thus is pressed flat against the garment G.

The timer once again actuates solenoid valve 64, pressurizing the lower end of cylinder 22, raising the head. As soon as this takes place, the timer actuates solenoid valve 67 to pressurize the cylinder 32 through its port 36, through line 72, thus swinging the arm 21 and the head carried thereby back over the hopper.

Almost simultaneously with the removal of the head from the member 51, the cylinder 74 actuates the sewing machine 50 so that it sews the label to the garment in the usual fashion. The timer times out after the sewing machine 50 completes its operation and the member 51 is raised to the dotted line position of FIG. 6, thus completing a cycle.

From the foregoing it will be seen that I have devised an improved process and apparatus for affixing labels to garments and the like. My improved process and apparatus is characterized by accuracy, speed, and simplicity of both steps and mechanism.

It will be understood that with my improved mechanism an operator may in fact operate two, side-by-side sewing machines. That is, the only thing the operator does is manually to place the garment G in correct sewing position underneath the then raised member 51. While the sewing operation is taking place at this station, the operator may place another garment under a similar machine. While I have not shown the second machine, it will be obvious that it is a mere duplication of the first apparatus, but it may be located within easy reach of an operator seated at a two-machine work station.

In actual operation my improved process and apparatus has proven to be extremely practical, is a great labor-saving concept and greatly reduces operator fatigue, thus improving production. By actual timing I find that an operator using a dual set-up as herein disclosed and shown, may in fact apply to garments as much as eight times as many labels in a given work period than can be done with the present, completely manual placement of the labels.

While I have shown my invention in but one form, it will be obvious to those skilled in the art that it is not so limited, but is susceptible of various changes and modifications without departing from the spirit thereof.

What I claim is:

1. Apparatus for delivering labels one by one to a sewing station at which a workpiece is positioned for receiving said label, comprising:

(a) an open top magazine or holder for a stack of labels, (b) label pick-up apparatus having a lower surface disposed to engage the uppermost label of the stack, (c) means to move the pick-up apparatus from a position in contact with the uppermost label in the magazine to a position to deposit the label onto a workpiece at the sewing station, (d) means to maintain at least a portion of the lower surface of the pick-up apparatus under sub-atmospheric pressure while picking up and transferring labels to the sewing station, (e) means to release said sub-atmospheric pressure after the labels are delivered to the sewing station, and (f) means at the sewing station to receive and engage a thus delivered label about at least a portion of its periphery, thereby to hold the label for sewing inwardly of its periphery.

2. Apparatus as defined in claim 1 in which the means at the sewing station to engage the label about at least a portion of its periphery is a centrally open frame-like hold-down member, said opening being dimensioned to permit the passage therethrough of the portion of the pick-up apparatus carrying a label, means to raise the said label hold-down member to a position above the level of the workpiece, permitting the label to be delivered through the opening therein and the positioning of the periphery of the label beneath said member, and means to lower the label hold-down member onto the workpiece, thereby to hold the label for sewing inwardly of its periphery.

3. Apparatus as defined in claim 1 in which the label pick-up apparatus comprises a first vertically disposed member, a second vertically disposed rotatable member, an arm fixed at one end to the second vertically disposed member and having the first vertically disposed member mounted for vertical reciprocation adjacent its other end, power means operatively connected to the first member for reciprocating it from position to contact the uppermost label in the stack to a position above the stack, and power means operatively connected to the second vertically disposed member to pivot the same and hence said arm from label pick-up position to a position with the label pick-up member over said means to engage the label at the sewing station.

* * * * *